US007722430B2

(12) United States Patent
Hippely

(10) Patent No.: US 7,722,430 B2
(45) Date of Patent: May 25, 2010

(54) TOY VEHICLE WITH IMPROVED ANIMATED FUNCTION

(75) Inventor: Keith Hippely, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 779 days.

(21) Appl. No.: 11/429,489

(22) Filed: May 4, 2006

(65) Prior Publication Data

US 2007/0259603 A1 Nov. 8, 2007

(51) Int. Cl.
*A63H 17/26* (2006.01)

(52) U.S. Cl. ..... 446/470; 446/431

(58) Field of Classification Search ..... 446/448, 446/431, 428, 470, 269, 279, 280, 287, 288; D21/548–566
See application file for complete search history.

(56) References Cited

U.S. PATENT DOCUMENTS 519,455 A * 5/1894 Klees ..... 298/14
4,561,854 A 12/1985 Amici et al.
4,568,307 A 2/1986 Gabler et al.
4,579,541 A 4/1986 Kulesza et al.
4,594,071 A 6/1986 Zaruba et al.
4,689,033 A 8/1987 Droller et al.
4,717,367 A 1/1988 Stubenfoll et al.
4,772,242 A 9/1988 McKay et al.
4,778,433 A 10/1988 McKay et al.
5,052,680 A 10/1991 Malewicki et al.
5,267,888 A 12/1993 Hippely et al.
5,292,275 A 3/1994 Swisher et al.
5,310,379 A 5/1994 Hippely et al.
5,334,078 A 8/1994 Hippely et al.
5,391,106 A 2/1995 Lidert, Jr.
5,580,296 A 12/1996 Chow
5,626,506 A 5/1997 Halford et al.
5,993,286 A * 11/1999 Tacquard et al. ..... 446/351
6,017,262 A 1/2000 Starnes
6,039,626 A 3/2000 Gerold et al.
6,220,921 B1 * 4/2001 Kim ..... 446/308
6,699,096 B2 3/2004 Christopherson et al.
2006/0014470 A1 1/2006 Takahashi et al.

* cited by examiner

*Primary Examiner*—Gene Kim
*Assistant Examiner*—Matthew B Stanczak
(74) *Attorney, Agent, or Firm*—Edell, Shapiro & Finnan LLC

(57) ABSTRACT

A toy vehicle having a plurality of play configurations, comprising a frame; a vehicle body moveably coupled to the frame with at least two degrees of freedom of movement, said two degrees of freedom of movement including a longitudinal translation of the body relative to the frame for selecting at least a first play configuration of the plurality of play configurations; and a rotation of the body relative to the frame for selecting at least a second of the plurality of play configurations.

23 Claims, 6 Drawing Sheets

TOY VEHICLE WITH IMPROVED ANIMATED FUNCTION

BACKGROUND AND SUMMARY

A variety of toys may be configured to provide different play configurations. In one example, a toy may provide a first play configuration simulating a vehicle and a second play configuration simulating an animal. For toy vehicles that simulate animals, it may be desirable for a play configuration to provide an action that is confrontational. In one approach, as described in U.S. Pat. No. 5,334,078 a toy may include a jaw or mouth that may be opened and closed, thereby providing confrontational play. However, the inventors herein have realized that this approach may provide only one type of confrontational play and may only confront toys of a particular size, for example.

The inventors herein have further realized that a single toy providing multiple forms of confrontation can be used to accommodate a variety of other toys, for example, of varying size and/or shape. In one approach a toy vehicle having a plurality of play configurations, comprising a frame; a vehicle body moveably coupled to the frame with at least two degrees of freedom of movement, said two degrees of freedom of movement including a longitudinal translation of the body relative to the frame for selecting at least a first play configuration of the plurality of play configurations; and a rotation of the body relative to the frame for selecting at least a second of the plurality of play configurations is provided.

In this manner, a toy vehicle may provide a plurality of play configurations. For example, when simulating an animal in a first play configuration, the toy may be able to confront toys that are smaller and/or lower to the ground via forward movement, enabling the mouth to access a lower region. In another example, when simulating an animal in a second play configuration, the toy may be able to confront other toys that are larger, enabling the mouth to access a higher region than the first play configuration. In this way it is possible to increase interaction with toys of varying size. Further, in one embodiment, the plurality of play configurations may be selected via a single hand position, thereby enabling a user to generate a variety of play configurations with improved ease and speed, thereby improving play.

While the toy may have a plurality of play configurations, it may also have only a single play configuration, such as rotation of the body relative to the frame, yet still provide play value via a user-actuatable mouth chomping feature, for example. Further, the toy may optionally include a retractable tongue that generates snake-like movement, thereby providing additional play value. These are just some of the variations and alternatives possible, and numerous more are described further herein.

DETAILED DESCRIPTION

FIGS. 1-5 show an example toy 100 having a variety of play configurations. In one example, as shown in FIG. 1A, toy 100 may be configured as a vehicle simulating a "monster" truck and/or racing vehicle, while in at least one other play configuration, as shown in FIGS. 2-5, toy 100 may simulate an animal such as, for example, a predatory tiger, dragon, dinosaur, lizard, bird, snake or other such animal, that may provide confrontation.

Figure 1A:
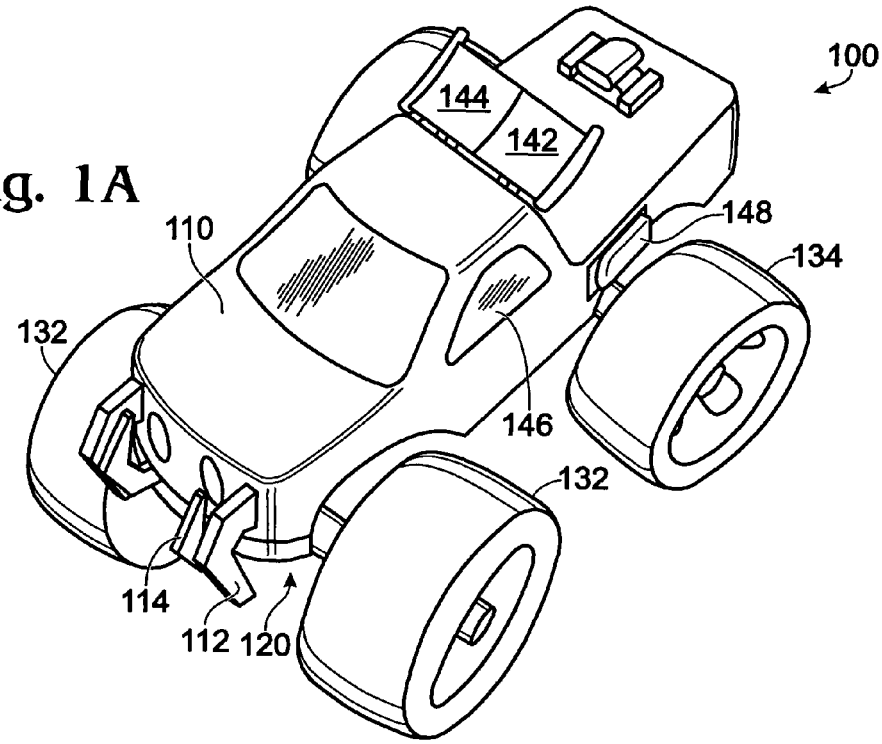
FIG. 1A shows an example toy vehicle in a first play configuration.

The example toy 100 described herein may include a body 110 coupled to a frame 120. In some embodiments, body 110 may include a decorative exterior finish indicative of an animal. For example, body 110 may include a plurality of spots, stripes, scales, and/or color variations to simulate an animal such as a tiger or monster. However, it should be appreciated that toy 100 may alternatively simulate other types of animals. A front portion of body 110 may further include front bumper portions 112 and 114, which may be configured to simulate teeth or fangs of an animal in other play configurations. Body 110 may further include one or more side windows such as window 146, which may be used to simulate an eye of an animal in other play configurations. Toy 100 may include two front wheels 132 and two rear wheels 134 rotatably coupled to frame 120. As shown in FIG. 1A, wheels 132 and 134 can be configured to simulate large or oversized monster truck wheels and/or tires.

Body 110 may also include one or more actuators such as, for example, spoilers 142 and 144, and/or body panels 148. One or more of these actuators can be actuated by a user to cause toy 100 to perform one or more operations as will be described below with reference to FIGS. 2-5. In some embodiments, actuation of at least one of the actuator(s) may cause toy 100 to produce sounds simulating an animal sound and/or a vehicle sound. For example, an animal sound may include a growling or chomping sound, while a vehicle sound may include a sound simulating an engine. In another example, the chomping or burping sounds may be produced upon closing of the vehicle's mouth (e.g. upon release of an actuator). Likewise, a different actuator, which may be coupled to a tongue to cause actuation of the tongue, may cause slurping or licking sounds.

Figures 1B, 2B, 2C, 2D:
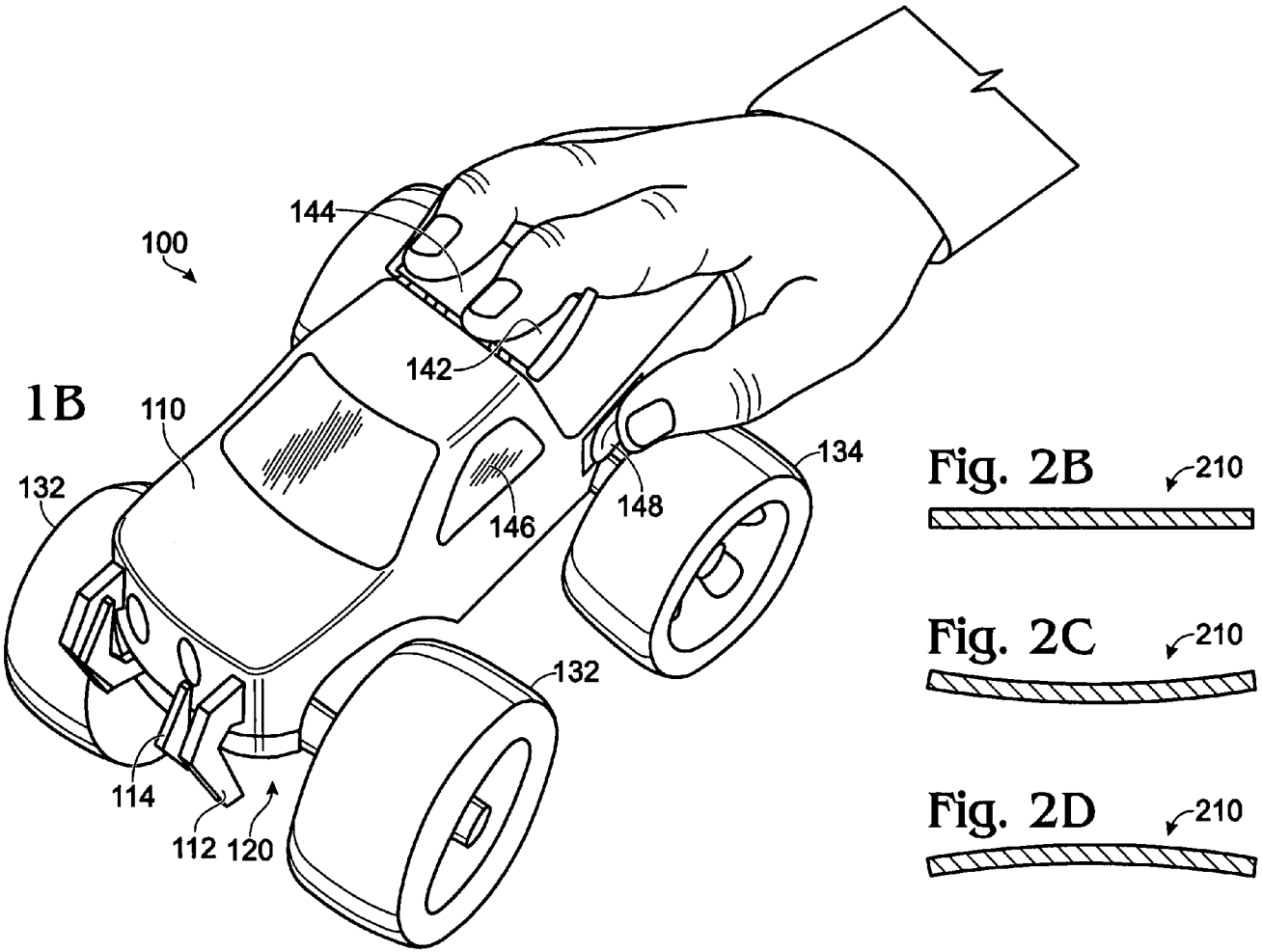
FIG. 1B shows the example toy vehicle of FIG. 1A with an example hand position for controlling the toy vehicle.
FIGS. 2B-2F show cross-sections of example retractable elements simulating a tongue.

In some embodiments, toy 100 may be configured to provide a plurality of play configurations that may be controlled by a single hand position. FIG. 1B shows the example toy 100 of FIG. 1A with an example hand position. In this example embodiment, the various actuators 142, 144, and/or 148 may be arranged so that they may be actuated via fingers of a users hand from a single hand position. For example, spoilers 142 and 144 may be arranged so that each spoiler may be actuated by a same or different finger of the same hand, while body panel 148 located on the side of the vehicle may be actuated by a thumb of the same hand. Further, as will be described below with reference to FIGS. 3-5, the body of toy 100 can be moveably coupled to the frame such that the natural range of motion of the hand about the wrist can cause movement of the body relative to the frame, enabling a user to select from a variety of play configurations and/or cause the toy to simulate a variety of animal and/or vehicle movements. In this manner, a single hand position may be able to control a plurality of toy operations, as well as actuate a plurality of actuators causing sound, lights, and/or movement of vehicle components. Further, in some embodiments, the actuation and/or release of one or more actuators may cause toy 100 to generate growling, burping, and/or slurping sounds.

Figure 2A:
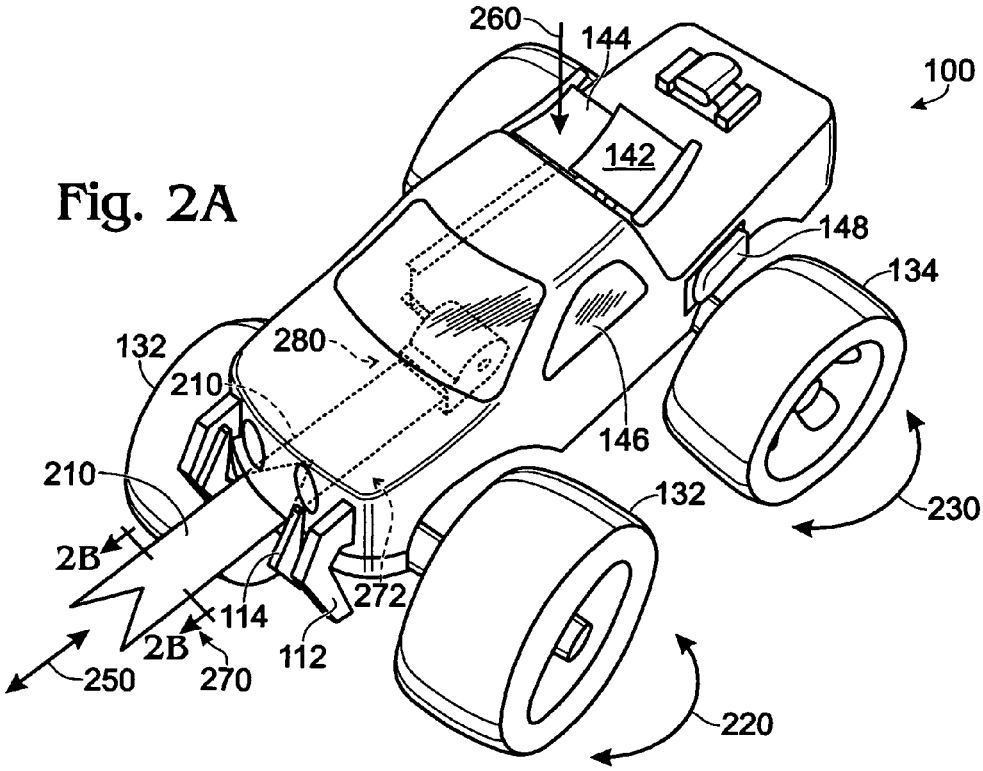
FIG. 2A shows the toy vehicle of FIG. 1A with a retractable element simulating a tongue.
Figure 2E:
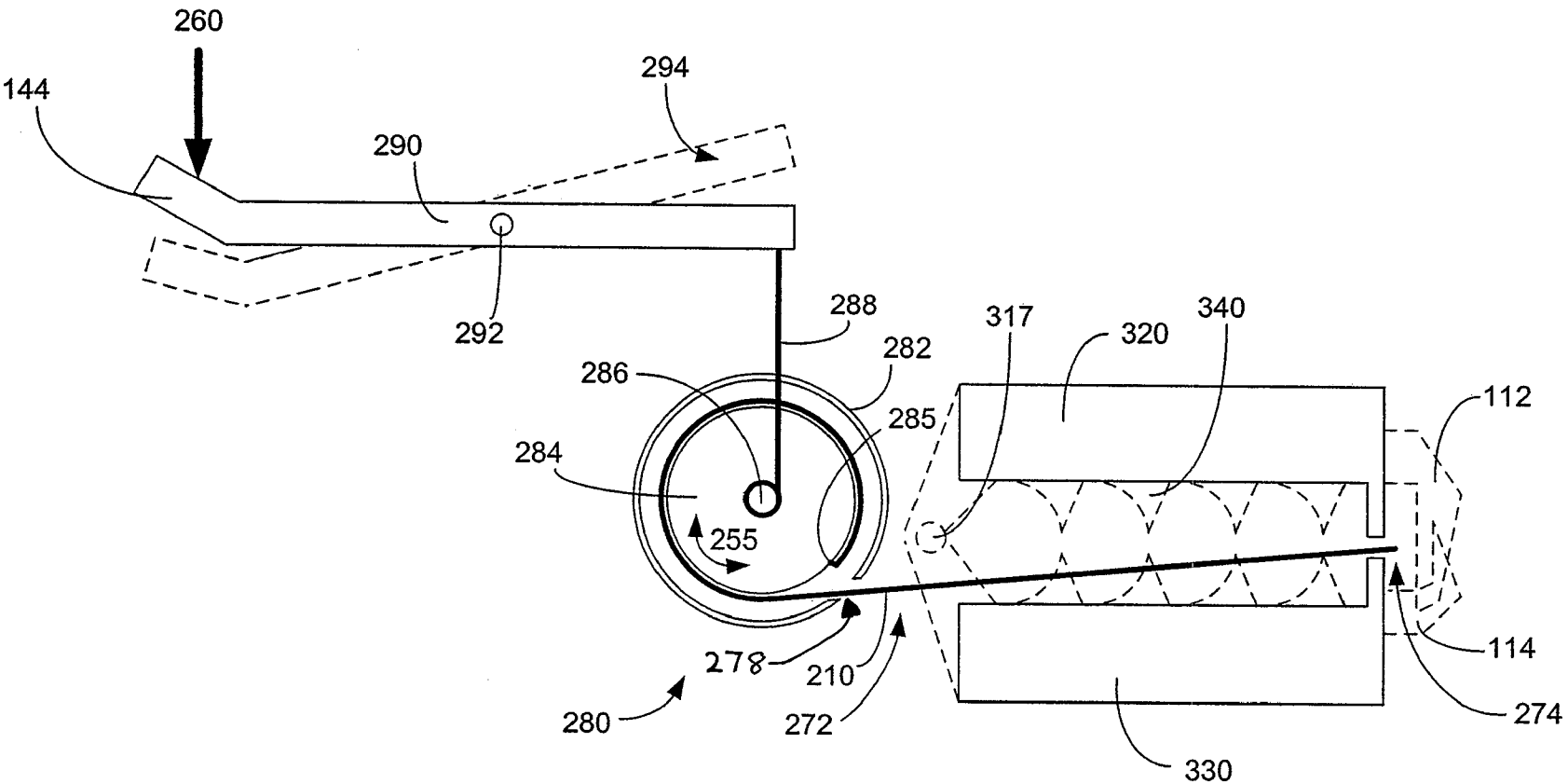
Figure 2F:
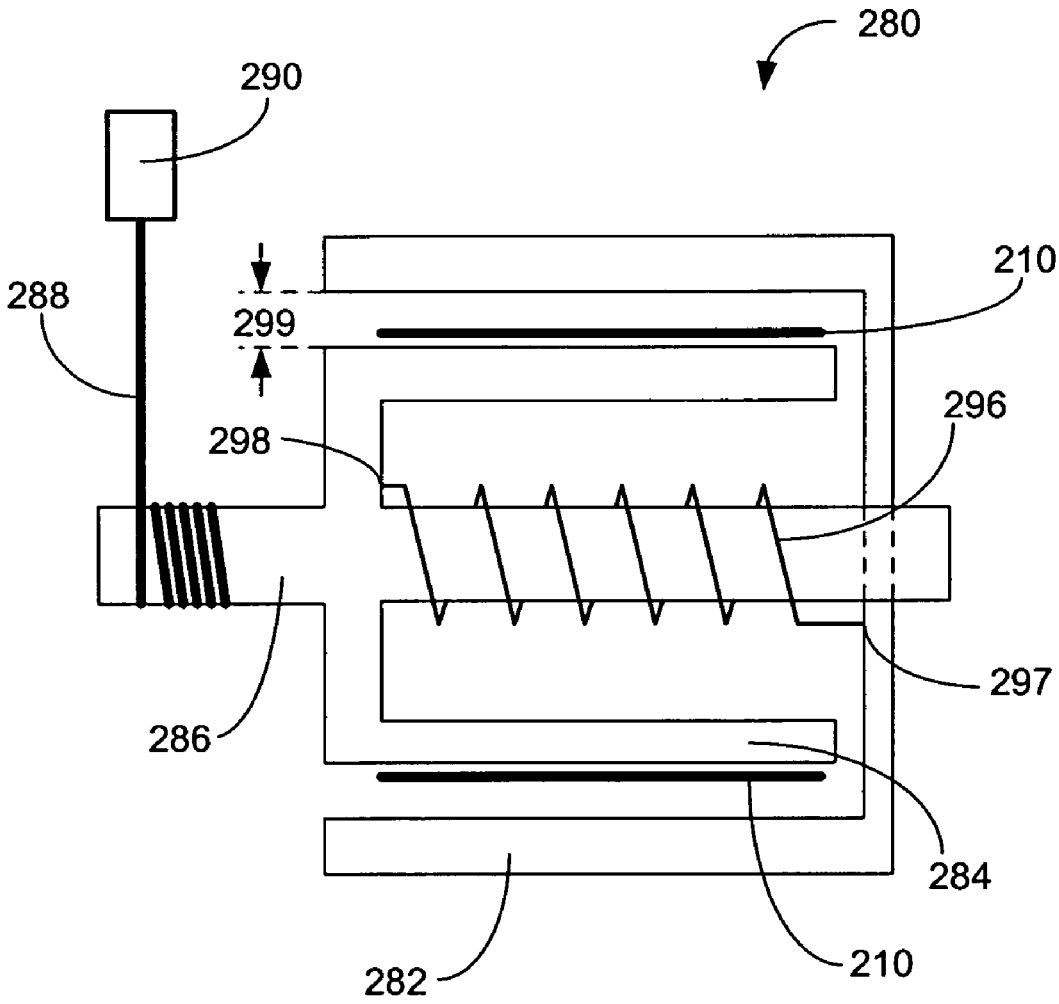

FIG. 2A shows toy 100 including a retractable element 210 simulating a tongue that may be extended outward from the body of the vehicle. As shown in FIG. 2A, element 210 may be extended to a position indicated at 270 in the direction indicated by vector 250 from a retracted position 272 within body 110. In some embodiments, element 210 can be coupled to at least one actuator causing the element to extend outward by an actuation such as a depression of spoiler 144 in the direction indicated by vector 260. Alternatively, element 210 may be actuated by spoiler 142 or side panel 148. Further, when actuated, the element can unroll or uncoil from retraction system 280, projecting outward from the vehicle to position 270, thereby further simulating tongue action. The uncoiling of the tongue upon actuation of an actuator may be facilitated by a spring such as, for example, torsional spring. Upon release of the actuator, the torsional spring may be configured to return the element to a coiled position. FIGS. 2E and 2F show retraction system 280 in greater detail.

In some embodiments, element 210 may comprise a material that is translucent or transparent. Further, element 210 can be sufficiently flexible and resilient, to enable the simulated tongue to support itself when extended outwards, while also enabling the tongue to bend or flex if necessary. In some embodiments, element 210 may be configured to vibrate or oscillate when extended toward position 270, thereby simulating a flicking of the tongue. For example, element 210 can temporarily vibrate in a lateral and/or vertical direction when extended outward from the vehicle upon actuation of the actuator. The level of flexibility and rigidity of material may be such that the uncoiling motion generates a vibration in at least an outer end portion (away from the mouth) to simulate flicking of the tongue, such as similar to that of a snake tongue. For example, the retractable element 210 may be configured to temporarily vibrate in a second direction substantially orthogonal to the vector 250 when extended outward from the vehicle upon actuation of the actuator. Element 210 may include materials such as plastic, vinyl and/or mylar, among other materials. Also, in some embodiments, the extending of element 210 may also be accompanied by sounds produced by the toy vehicle, such as hissing sounds.

As shown in FIG. 2A, element 210 may simulate a tongue having a shape that is substantially flat or planar in a plane substantially parallel to the ground surface, enabling the element to be rolled or coiled when in a retracted position 272. For example, FIGS. 2B, 2C, and 2D show example cross-sections for element 210. FIG. 2B shows element 210 with a flat planar cross-section. FIGS. 2C and 2D show element 210 with a curved planar cross-section. For example, FIG. 2C shows element 210 with a convex side facing downward, while FIG. 2D shows element 210 with a convex side facing upward. However, it should be appreciated that the curved cross-sections of FIGS. 2C and 2D may be more or less curved The various cross-sections shown in FIGS. 2B, 2C, and 2D, among others can be used to vary the ability of element 210 to retain a rolled position, maintain a self supporting position when un-rolled, and vary the vibration and/or lateral developed in the element when extended or retracted. For example, the cross section of FIG. 2B may provide more vibration or lateral motion of element 210 when extended than cross-sections 2C and 2D, at least under some conditions. In another example, the cross-sections shown in FIGS. 2C and 2D can provide more support to element 210 when in the extended position than the cross-section of FIG. 2B, at least under some conditions. In some embodiments, element 210 may also include a pre-set curve or bend along the longitudinal axis of the element. This preset bend can be added no matter what the cross-section of element 210, for example, as shown in FIGS. 2B, 2C, and 2D. The pre-set bend or curve can be included to better enable element 210 to unroll and/or to enable element 210 to curve upward when extended.

While FIG. 2 shows a tongue that is fully contained within the vehicle in the retracted position, it may be more advantageous if the tongue sticks out slightly in the retracted position so that it does not become blocked. Thus, the tongue may extend outward even in the retracted position. Further details of an example mechanism for retaining and extending a tongue element is described herein with regard to FIGS. 2E and 2F.

FIGS. 2E and 2F schematically show an example system for retracting and extending element 210. In particular, FIG. 2E shows a side view (i.e. longitudinal cross-section) of toy 100 including retraction system 280, while FIG. 2F shows a front view and cross section of retraction system 280. As shown in FIG. 2E, spoiler 144 may be coupled to a linkage 290, which may be moveably coupled to body 110 by joint 292. In this way, when spoiler 144 is actuated via a downward motion indicated by vector 260, linkage 290 may rotate as indicated to position 294, for example, shown in FIG. 2E by a broken line. Further, linkage 290 can be coupled to an axle 286 of retraction system 280 via a flexible cord or cable 288.

Retraction system 280 may include an outer drum 282 and an inner drum 284. Inner drum 284 can be moveably coupled to outer drum 282 by an axle 286, enabling rotation of inner drum 284 relative to outer drum 282 as indicated by vector 255. Cord 288 may be coupled and/or wrapped around axle 286 as shown in FIGS. 2E and 2F. Element 210 is shown coupled to inner drum 284 as shown at 285 and wrapped around the outer surface of the inner drum. Element 210 can be wound less than one full revolution around inner drum 284 when retracted, thereby reducing binding or kinking of the element during rotation of the inner drum. Element 210 may extend outside of outer drum 282 via an opening 278. In this manner, movement of linkage 290 via an actuation of spoiler 144 can cause inner drum 284 to rotate in a first direction relative to outer drum 282, causing element 210 to move or extend outward from position 272 toward position 270 as shown in FIG. 2A.

In an alternate embodiment, actuation of spoiler 144 (or other actuator) may cause element 210 to extend from retraction system 280 via one or more gears. For example, spoiler 144 may be coupled to a first gear, which in turn may be mated with a second gear attached to axle 286. In this manner, movement of spoiler 144 (e.g. a downward motion as indicated by vector 260 can cause rotation of axle 286. Furthermore, it should be appreciated that one or more intermediate gears may be used to transfer motion of one or more actuators to the axle of retraction system 280.

Retraction system 280 may also include a spring such as torsional spring 296 for retracting element 210 to position 272 when an actuator such as spoiler 144 is not depressed. For example, FIG. 2F shows torsional spring 296 wrapped around axle 286, and having one end coupled to outer drum 282 generally at 297 and another end coupled to inner drum 284 generally at 298. Torsional spring 296 can be sized or configured to provide sufficient force to cause inner drum 284 to rotate in an opposite direction, thereby causing element 210 to retract from position 270 to position 272, for example.

It should be appreciated that the distance between outer drum 282 and inner drum 284 as shown by dimension 299 can be sized to reduce kinking and/or binding of element 210 when retracted and/or extended, while also enabling element 210 to move relative to the outer drum. Further, FIG. 2E shows element 210 in relation to body 110, and more specifically to upper portion 320 and lower portion 330 for simulating an animal's mouth. Upper and lower portions 320 and 330 are shown (as broken lines) having a plurality of teeth 340, as well as front bumper portions 112 and 114 for simulating fangs. Upper and lower portions 320 and 330 are shown moveably coupled by joint 317. It should be appreciated that the various portions shown by broken lines in FIG. 2E reside on either side of element 210 and therefore do not obstruct element 210 when translating along vector 250 as shown in FIG. 2A. For example, element 210 can pass between left and right rows of teeth 340. Further, as shown in FIG. 2E generally at 274, element 210 can protrude beyond various obstructions caused by upper and lower portions 320 and 330 when in the retracted position 272. In this way, element 210 can be extended to position 270 without interference caused by various body portions, while being substantially hidden when retracted to position 272.

In some embodiments, element 210 can be biased at an angle relative to the horizontal ground surface. For example, FIG. 2E shows how element 210 can be configured to project from retraction system 280 at a slight upward angle. This angle can cause element 210 to move or vibrate differently when extended and/or retracted. For example, a pre-set upward angle of element 210 can cause the end of element 210 to move first upwards rapidly, then downward, then up again and so forth in a vibratory manner to simulate a snake tongue. In some embodiments, element 210 can be formed in with a pre-set curved configuration along at least a portion of the longitudinal direction to provide the desired vibrational response and/or structural support when extended and/or retracted. Thus, either or both of the angle and pre-set can be used to initiate or amplify the vibration caused by the extension of element 210, thereby providing amplified vibration to simulate a snake tongue. It should be appreciated that element 210 can be pre-set to bend and/or curve in an upward or downward direction when extended. Further, the pre-set or warping may be to all or only a portion of element 210.

The relative size and/or arrangement of the various portions of the retraction system can be configured to cause element 210 to rapidly extend and/or retract, thereby causing vibration of element 210. For example, joint 292 can be positioned along linkage 290 so that a relatively small actuation causes a relatively large movement of element 210. Alternatively, if gears are used, a gear ratio may be selected to provide a desired response of element 210 when an actuator is actuated by a user.

Returning to FIG. 2A, in some embodiments, front wheels 132 may be coupled to frame 120 by a common front shaft enabling rotation of the front wheels about the front shaft and also enabling rotation of the front wheels about a vertical axis along vector 220. Similarly, in some embodiments, rear wheels 134 may be coupled to frame 120 by a common rear shaft enabling rotation of the rear wheels about the rear shaft and also enabling rotation of the rear wheels about a vertical axis along vector 230. For example, in some embodiments, the front and/or rear shafts coupling front wheels 132 and rear wheels 134, respectively may pass through frame 120 via a slotted opening, enabling the front and/or rear shafts to vary in position relative to the frame. In some embodiments, the front and/or rear shafts may be moveably coupled to the frame enabling the shaft to pivot about a central axis relative to the frame. In this manner, vehicle body 110 may have front and/or rear wheel steering capability, which may be used to enable the vehicle to simulate a crawling motion, thereby further simulating animal movement. Furthermore, body 110 may be moveably coupled to frame 120 in a manner that enables body 110 to rotate or rock about a longitudinal axis, providing side to side motion. The rotation of body 110 relative to frame 120 can enable toy 100 to further simulate animal movement, such as during crawling motion.

Figure 3:
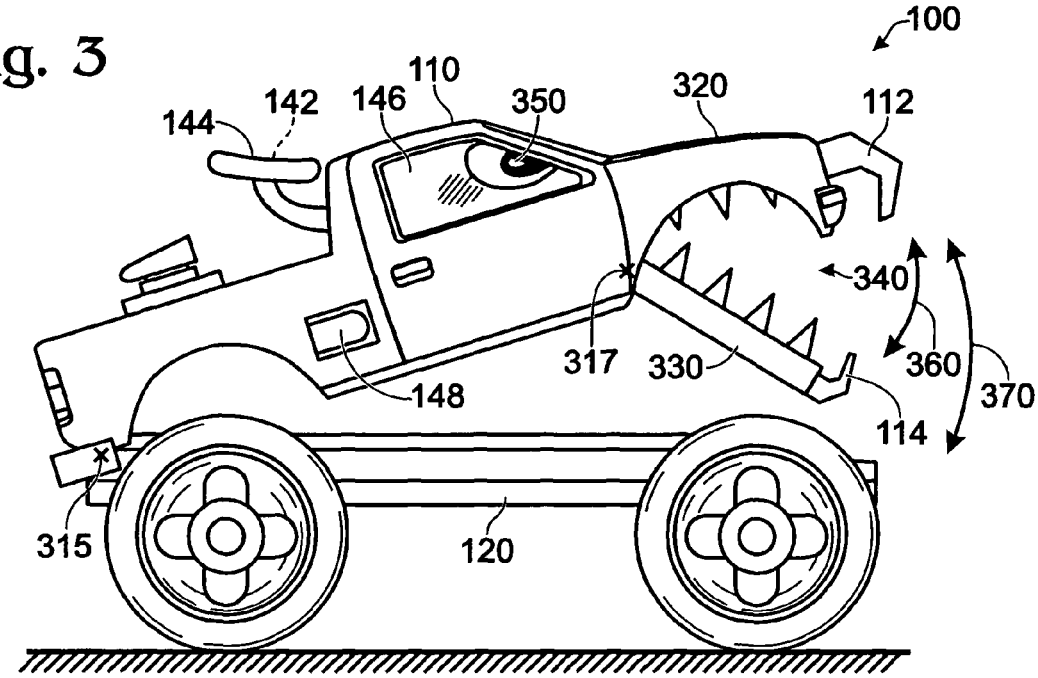
FIGS. 3-5 show the toy vehicle of FIG. 1A in different play configurations.

FIG. 3 shows toy 100 in another play configuration simulating an animal in a confrontational position. A rear portion of body 110 is shown moveably coupled to a rear portion of frame 120 generally at 315 enabling rotation of the body relative to the frame as indicated by vector 370. Further, body 110 may include an upper portion 320 and a lower portion 330 moveably coupled generally at 317 for simulating an upper and lower jaw of a mouth, respectively. These upper and/or lower jaw portions may include one or more teeth generally at 340. In this manner, upper and lower portions 320 and 330, teeth 340, and bumper portions 112 and 114 can simulate the mouth of an animal. In the play configuration shown in FIG. 3, the mouth simulated by upper and lower portions 320 and 330 are open in a region that is higher than the region of the play configuration shown in FIG. 5. In this manner, toy 100 can provide different types of confrontational play, where the confrontation may be made toward different positions/heights.

In some embodiments, window 146 may also be configured with a moveable portion 350 therein, including a visual design such as, for example, a simulated eye. This moveable portion can be coupled to lower portion 330 forming the lower jaw of the mouth such that when the mouth is opened, the moveable portion occupies the viewable window region, thereby exposing the eye. When the mouth is closed, the moveable portion may move outside of the viewable portion of the window and may be hidden within the body of the vehicle. Alternatively, moveable portion 350 may instead be activated in response to rotating or translating body 110 relative to frame 120 and/or by actuation of one or more actuators.

Toy 100 can be operated between the play configuration of FIG. 1A and FIG. 3 by rotating the body 110 relative to the frame 120 along vector 370. It should be appreciated that toy 100 may be varied between these play configurations by a single hand position, for example, as shown in FIG. 1B. In some embodiments, portions 320 and 330 may separate or open when the front end of the body is rotated upward relative to the frame, thereby simulating a first confrontational play. The opening of the mouth may be assisted by gravity, for example. Further, in some embodiments, the opening of the simulated mouth by the rotation of lower jaw portion 330 relative to upper jaw portion 320 may be accompanied by sounds such as, for example, an animal growling sound.

Figure 4:
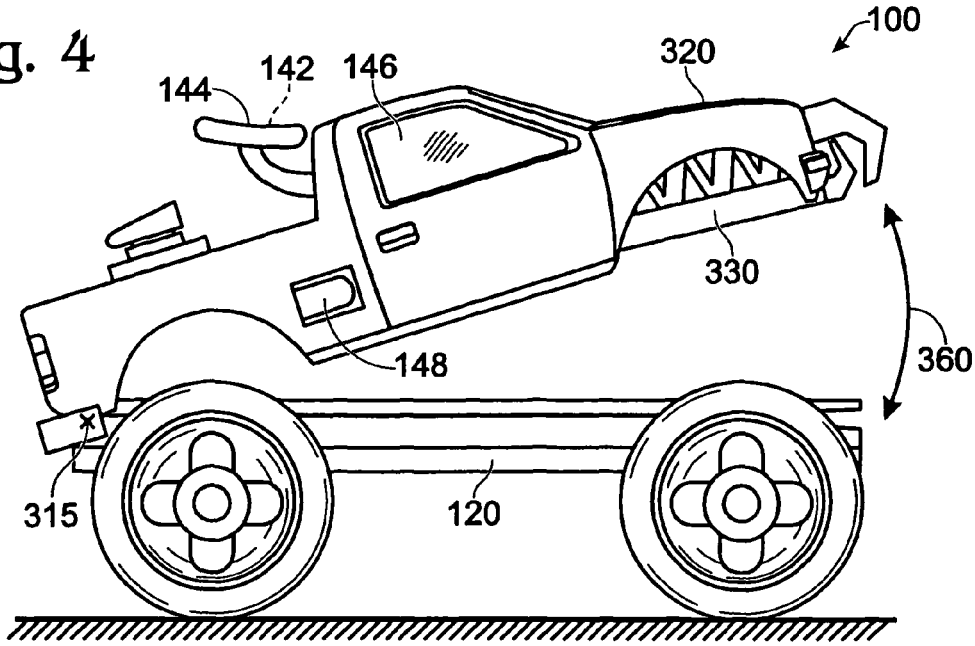

FIG. 4 shows upper and lower body portions 320 and 330 of toy 100 in a closed configuration. These portions simulating a mouth may be moved between the configurations of FIG. 3 and FIG. 4 as indicated by vector 360 by actuating at least one of the actuators, such as, spoilers 142, 144 and/or side panel 148. In this manner, the toy vehicle may simulate an animal having a chomping or chewing capability. In some embodiments, the toy vehicle may produce a sound accompanying the opening and/or closing of the mouth.

Figure 5:
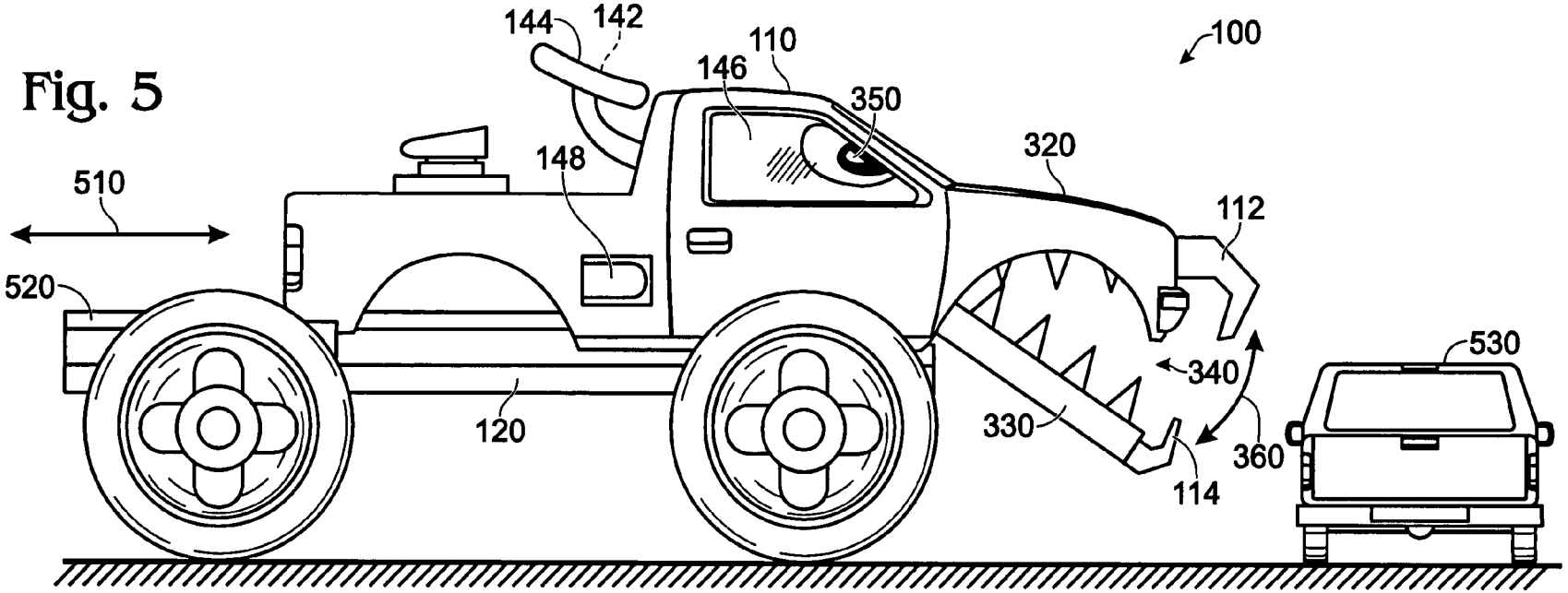

FIG. 5 shows toy 100 in a play configuration simulating an animal having a confrontational forward stance. In this play configuration, body 110 may be translated forward relative to frame 120 longitudinally along vector 510 via a track 520. The forward motion may be enabled by sliding of body 110 relative to frame 120 via track 520. In this manner, body 110 may be moveably coupled to frame 120 via track 520. In some embodiments, lower portion 330 simulating the lower jaw of the mouth may be configured to rotate downward from upper portion 320 simulating the upper jaw of the mouth when the vehicle body 110 is translated forward. In this manner, lower body portion can be rotated toward and/or contact the ground surface, enabling the mouth to be open in a region lower than the region shown above in FIG. 3. In this manner, toy 100 can provide another confrontational play configuration, enabling toy 100 to pick up and/or simulate eating other items, such as smaller vehicle 530. Further, in some embodiments, the translation of body 110 relative to frame 120 may cause toy 100 to produce various sounds. It should be appreciated that toy 100 may be returned to the play configuration of FIG. 1A by translating the body rearward along vector 510 relative to the frame, while maintaining the same hand position as shown in FIG. 1B As described herein, toy 100 may be varied between play configurations simulating a vehicle and/or an animal having a variety of confrontational positions. In some examples, these play configurations may be selected or varied by rotating and/or translating the body relative to the frame and various actions may be selected by actuating one or more actuators disguised as vehicle body portions. These actuators may be arranged to enable the selection of various actions or operations via a single hand placement. Furthermore, the translation and/or rotation of the body, or actuation of one or more actuators may be accompanied by various sounds that may simulate the sounds produced by the selected play configuration It will be appreciated that the configurations and embodiments disclosed herein are exemplary in nature, and that these specific embodiments are not to be considered in a limiting sense, because numerous variations are possible. The components, shapes, colors, etc. described herein are non-limiting examples and it should be understood that each of these features may be changed.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A toy vehicle having a plurality of play configurations, comprising:

a frame having a rear portion, a front portion, and a track, the track being intermediate the rear portion and the front portion;

a vehicle body having a rear portion and a front portion, wherein the rear portion of the vehicle body is slidably and rotatably coupled to the track, allowing for at least two degrees of freedom of movement, said two degrees of freedom of movement including a longitudinal translation of the body relative to the frame for selecting at least a first play configuration of the plurality of play configurations, wherein the rear portion of the vehicle body is slidably moveable between the rear portion of the frame and the front portion of the frame; and a rotation of the body relative to the frame for selecting at least a second of the plurality of play configurations, wherein the rear portion of the vehicle body is rotatably coupled to the track.

2. The toy vehicle of claim 1, wherein the vehicle body includes an upper portion and a lower portion moveably coupled to the upper portion, and wherein the upper portion and the lower portion simulate a mouth.

3. The toy vehicle of claim 2, wherein both the longitudinal translation and the rotation of the body relative to the frame causes the lower portion to move relative to the upper portion.

4. The toy vehicle of claim 2, wherein when the first play configuration is selected, the simulated mouth is opened in a first region and when the second play configuration is selected, the simulated mouth is opened in a second region, said second region being higher off the ground than said first region.

5. The toy vehicle of claim 2, further comprising an actuator configured to cause the lower portion to rotate toward the upper portion when the simulated mouth is open, wherein upon release of the actuator at least one of growling, burping, or slurping sounds is generated.

6. The toy vehicle of claim 1, further comprising a retractable element simulating a tongue, and an actuator configured to cause the retractable element to extend outward from the vehicle body upon actuation.

7. The toy vehicle of claim 1, wherein each of the plurality of play configurations may be selected with a single hand position.

8. The toy vehicle of claim 6, wherein the retractable element is retracted within the vehicle when not extended outward from the vehicle and wherein the retractable element is rolled when retracted within the vehicle and at least partially unrolled when extended outward from the vehicle.

9. The toy vehicle of claim 6, wherein the retractable element is extendable from the vehicle in a first direction, the retractable element has a curved shape in its free state such that it temporarily vibrates in a second direction substantially orthogonal to the first direction when extended outward from the vehicle upon actuation of the actuator.

10. The toy vehicle of claim 6, wherein the retractable element is sufficiently flexible and rigid so that upon actuation, a vibration is generated in the retractable element when the retractable element is extended by unrolling, said vibration in the retractable element simulating a flicking action of a snake tongue.

11. The toy vehicle of claim 1, wherein the track extends from an end of the rear portion of the frame to an end of the front portion of the frame.

12. A toy vehicle, comprising:

a frame having a rear portion, a front portion, and a track, the track being intermediate the rear portion and the front portion; and a vehicle body having a rear portion and a front portion, wherein the rear portion of the vehicle body is slidably and rotatably coupled to the track, the body including an upper portion and a lower portion movably coupled to the upper portion for simulating a mouth, the lower portion configured to move relative to the upper portion upon sliding of the body relative to the frame.

13. The toy vehicle of claim 12, wherein the movement of the lower portion relative to the upper portion includes rotation of the lower portion relative to the upper portion.

14. The toy vehicle of claim 13, wherein a front end of the lower portion rotates away from a front end of the upper portion when the vehicle body slides in a forward direction relative to the frame.

15. The toy vehicle of claim 14, wherein the front end of the lower portion rotates toward the front end of the upper portion when the lower portion engages the frame as the vehicle body slides in a rearward direction relative to the frame.

16. The toy vehicle of claim 14, wherein the rotation of the lower portion relative to the upper portion is facilitated by gravity and simulates opening of a mouth.

17. The toy vehicle of claim 12, further comprising a retractable element simulating a tongue and an actuator configured to cause the retractable element to extend outward from the vehicle body upon actuation.

18. The toy vehicle of claim 12, further comprising an actuator configured to cause the lower portion to rotate relative to the upper portion.

19. The toy vehicle of claim 12, wherein the track extends from an end of the rear portion of the frame to an end of the front portion of the frame.

20. A toy vehicle, comprising:

a frame having a rear portion, a front portion, and a track, the track being intermediate the rear portion and the front portion;

a body having a rear portion and a front portion, wherein the rear portion of the body is slidably and rotatably coupled to the track, and the front portion of the body includes at least a first portion and a second portion, wherein the first portion is moveably coupled to the second portion and wherein the first portion and the second portion simulate a mouth;

a retractable element simulating a tongue and disposed between the first portion and the second portion;

a first actuator coupled to at least one of the first portion and the second portion, wherein the first actuator is configured to move the first portion relative to the second portion when actuated; and a second actuator coupled to the retractable element, wherein the second actuator is configured to move at least a portion of the retractable element outwardly from the body when actuated.

21. The toy vehicle of claim 20, wherein the toy vehicle generates a sound responsive to at least one of an actuation of one of the actuators and a release of one of the actuators, the vehicle further comprising a plurality of wheels.

22. The toy vehicle of claim 20, further comprising a frame moveably coupled to the body, wherein the first portion is moved relative to the second portion when the frame is moved relative to the body, and wherein said second actuator is positioned such that a finger of a user's hand can actuate said second actuator while holding said first portion away from the second portion.

23. The toy vehicle of claim 20, wherein the track extends from an end of the rear portion of the frame to an end of the front portion of the frame.

* * * * *